US011746591B2

(12) United States Patent
Jiang et al.

(10) Patent No.: US 11,746,591 B2
(45) Date of Patent: Sep. 5, 2023

(54) SMART SUNSHADE CURTAIN WITH REPLACEABLE BATTERY

(71) Applicant: NINGBO SUNFREE MOTOR TECHNOLOGY COMPANY LIMITED, Ningbo (CN)

(72) Inventors: Chun Jiang, Ningbo (CN); Baoguo Tan, Ningbo (CN)

(73) Assignee: NINGBO SUNFREE MOTOR TECHNOLOGY COMPANY LIMITED, Ningbo (CN)

( * ) Notice: Subject to any disclaimer, the term of this patent is extended or adjusted under 35 U.S.C. 154(b) by 51 days.

(21) Appl. No.: 17/488,337

(22) Filed: Sep. 29, 2021

(65) Prior Publication Data

US 2022/0298853 A1 Sep. 22, 2022

(30) Foreign Application Priority Data

Mar. 18, 2021 (CN) ..... 202120562239.3

(51) Int. Cl.
*E06B 9/322* (2006.01)
*E06B 9/42* (2006.01)
*E06B 9/72* (2006.01)

(52) U.S. Cl.
CPC ..... *E06B 9/322* (2013.01); *E06B 9/42* (2013.01); *E06B 9/72* (2013.01); *E06B 2009/3222* (2013.01)

(58) Field of Classification Search
CPC ... E06B 9/42; E06B 9/322; E06B 9/72; E06B 2009/3222; E06B 9/40; E06B 9/70; E06B 9/68
See application file for complete search history.

(56) References Cited

U.S. PATENT DOCUMENTS 6,371,192 B1 * 4/2002 Anderson ..... E06B 9/323 429/100
6,382,294 B1 * 5/2002 Anderson ..... E06B 9/323 429/100
8,065,039 B2 * 11/2011 Mullet ..... E06B 9/68 700/13
10,895,105 B1 * 1/2021 Marchese ..... E06B 9/322
2003/0168187 A1 * 9/2003 Wen ..... E06B 9/32 160/168.1 P
2006/0121337 A1 * 6/2006 Cheng ..... H01M 50/213 429/97

(Continued)

*Primary Examiner* — Beth A Stephan

(57) ABSTRACT

A smart sunshade curtain with a replaceable battery is provided which comprises a cross beam and mounting components covered on both ends of the cross beam; a power mechanism is disposed in the cross beam and has a drawer that may be pulled out of or pushed into one end of the cross beam, and battery assemblies are arranged in the drawer; a drive mechanism is disposed at the other end of the cross beam opposed to the power mechanism; the power mechanism transmits power to the drive mechanism to drive an output mechanism to move a curtain cloth. In the above structure, the batteries are arranged in sequence in the drawer mounted inside the cross beam, which facilitates spatial arrangement design of internal elements of the cross beam and prevents the batteries from being exposed to the outside, thereby improving aesthetics of the smart curtain.

6 Claims, 5 Drawing Sheets

(56) References Cited

U.S. PATENT DOCUMENTS

| | | | | |
|---|---|---|---|---|
| 2009/0014132 | A1* | 1/2009 | Cheng | E06B 9/322<br>160/168.1 P |
| 2010/0092855 | A1* | 4/2010 | Cheng | H01M 50/213<br>429/163 |
| 2010/0269988 | A1* | 10/2010 | Mullet | E06B 9/72<br>160/310 |
| 2012/0090797 | A1* | 4/2012 | Mullet | E06B 9/322<br>160/331 |
| 2014/0231032 | A1* | 8/2014 | Blair | E06B 9/68<br>160/310 |
| 2014/0305602 | A1* | 10/2014 | Kirby | E06B 9/40<br>160/310 |
| 2018/0058143 | A1* | 3/2018 | Selogy | E06B 9/68 |
| 2018/0171710 | A1* | 6/2018 | Kirby | E06B 9/72 |
| 2018/0202225 | A1* | 7/2018 | Lagarde | E06B 9/72 |
| 2020/0386048 | A1* | 12/2020 | Larsson | E06B 9/72 |
| 2021/0140233 | A1* | 5/2021 | Chat | E06B 9/60 |
| 2021/0363822 | A1* | 11/2021 | Blair | E06B 9/62 |

* cited by examiner

SMART SUNSHADE CURTAIN WITH REPLACEABLE BATTERY

CROSS REFERENCE TO THE RELATED APPLICATIONS

This application is based upon and claims priority to Chinese Patent Application No. 202120562239.3, filed on Mar. 18, 2021, the entire contents of which are incorporated herein by reference.

TECHNICAL FIELD

The present invention relates to a sunshade curtain, and in particular to a smart sunshade curtain with a replaceable battery.

BACKGROUND

To facilitate life and improve quality, smart household products are applied more and more widely. At present, there are many types of electric curtains, such as electric roller curtains and electric blind curtains on market. A power supply is needed for a drive device of the electric curtain. The power supplies are mainly divided into a wired power supply (directly connected to an external power supply) and a wireless power supply (a battery pack). The wireless power supply, which is usually in the form of battery pack, has a broader application prospect because no consideration has to be given to external power supply in a mounting location. However, in the existing electric curtains, the battery packs are pre-built in the drive devices and cannot be replaced. Further, due to different reasons, the built-in battery pack is prone to bring after-sales problems now. In addition, power loss begins immediately after assembly is completed. The power loss of the battery in storage or transit is a useless loss which shortens an actual service life of the battery. In this case, it is urgent to make a safer and easily-replaceable battery pack with a longer service life in the industry.

SUMMARY

To solve the above technical problems, the present invention provides a smart electric sunshade curtain with a battery assembly easily assembled and disassembled.

The technical solution of the present invention is to provide a smart sunshade curtain with a replaceable battery, comprising a cross beam and mounting components covered on both ends of the cross beam. A power mechanism is disposed in the cross beam and has a drawer that may be pulled out of or pushed into one end of the cross beam, and battery assemblies are arranged in the drawer; a drive mechanism is disposed at the other end of the cross beam opposed to the power mechanism; the power mechanism transmits power to the drive mechanism to drive an output mechanism to move a curtain cloth.

In the above structure, the batteries are arranged in sequence in the drawer mounted inside the cross beam, which facilitates spatial arrangement design of internal elements of the cross beam and prevents the batteries from being exposed to the outside, thereby improving aesthetics of the smart curtain. In addition, the power mechanism may be assembled or disassembled at any time. In this way, repair, replacement or charge of the power mechanism can be facilitated, and the batteries can be separated from the smart curtains during sales or transportation so as to reduce unnecessary power losses.

Further, the power mechanism and the drive mechanism are electrically connected by an electric wire. Preferably, the electric wire may be extended or retracted as the drawer is pulled or pushed.

Further, the power mechanism and the drive mechanism are electrically connected by a connection point of the electric wire that can be disconnected.

Further, the power mechanism is disposed at an end of the cross beam, an opening for the drawer to pass through is disposed on the mounting component at this end, and a pull plate for covering the opening is correspondingly disposed on the drawer.

Preferably, a guide strip parallel to an axis of the cross beam is disposed at an inner wall of the mounting component with the opening.

More preferably, a first locking element is disposed on the mounting component with the opening, and a second locking element mated with the first locking element is disposed on the pull plate, such that two locking elements may be mated with each other, so as to fix the drawer inside the cross beam after the drawer is pushed into the cross beam.

Further, the power mechanism is disposed at an end of the cross beam, the mounting component at this end closes the end after being covered on the end, and a limiting column to be abutted against the power mechanism is disposed at the inner wall of the mounting component.

BRIEF DESCRIPTIONS OF THE DRAWINGS

Figure 1:
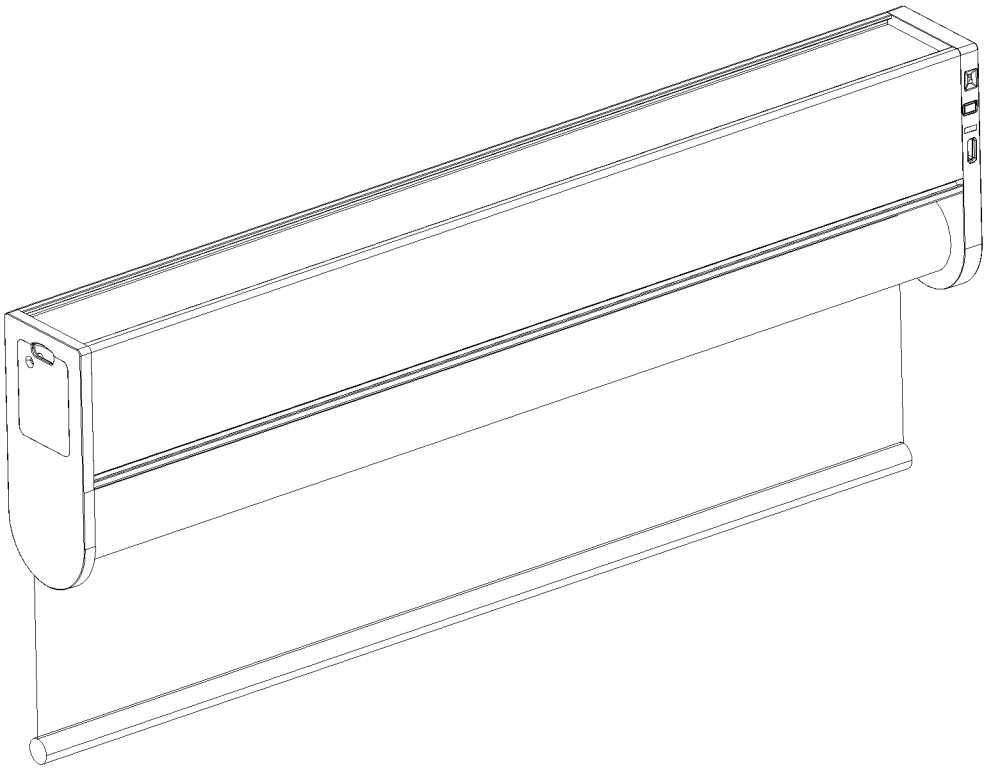
FIG. 1 is a perspective view of a smart roller curtain with a replaceable battery according to an embodiment of the present invention.

Numerals of the drawings are described as follows: 1—cross beam, 2*a*, 2*b*—mounting component, 2*ai*—guide strip, 2*aii*—screw hole, 2*bi*—limiting column, 3—drawer, 31—pull plate, 4—battery assembly, and 5—curtain cloth.

EMBODIMENTS

The present invention will be further described below in combination with specific embodiments.

In the descriptions of the present invention, it is to be understood that an orientation or position relationship indicated by the terms such as "central", "longitudinal", "transverse", "length", "width", "thickness", "upper", "lower", "front", "rear", "left", "right", "vertical", "horizontal", "top", "bottom", "inside", "outside", "clockwise", "counterclockwise", "axial", "radial" and "circumferential" is used only for ease of descriptions of the present invention and simplification of the descriptions and does not indicate or imply that the indicated devices or elements must have a particular orientation, or be constructed and operated in a particular orientation. Therefore, such terms shall not be understood as limiting of the present invention.

In addition, the terms "first" and "second" are used only for descriptions and shall not be understood as indicating or implying relative importance or implicitly indicating the number of the indicated technical features. As a result, the features defined by "first" and "second" may explicitly or implicitly comprise at least one feature. In the descriptions of the present invention, "several" refers to at least two, for example, two or three or the like, unless otherwise clearly stated.

In the present invention, unless otherwise clearly stated or defined, the terms "mount", "connect", "couple" and "fix", and the like shall be understood in a broad sense, for example, may be fixed connection, or detachable connection, or formed into one piece; or may be mechanical connection, or electrical connection; or may be direct connection or indirect connection through an intermediate medium, or may be internal communication between two elements or mutual interaction of two elements. Those of ordinary skill in the art may understand the specific meanings of the above terms in the present invention according to actual situations.

In the present invention, unless otherwise clearly stated or defined, the first feature being "on" or "below" the second feature refers to that the first feature and the second feature are in direct contact, or the first feature and the second feature are in indirect contact through an intermediate medium. Furthermore, the first feature being "on", "above" or "over" the second feature refers to that the first feature is exactly above or obliquely above the second feature, or only refers to that the first feature has a higher horizontal height than the second feature. The first feature being "under", "below" or "underneath" the second feature refers to that the first feature is exactly below or obliquely below the second feature, or only refers to that the first feature has a smaller horizontal height than the second feature.

Figure 2:
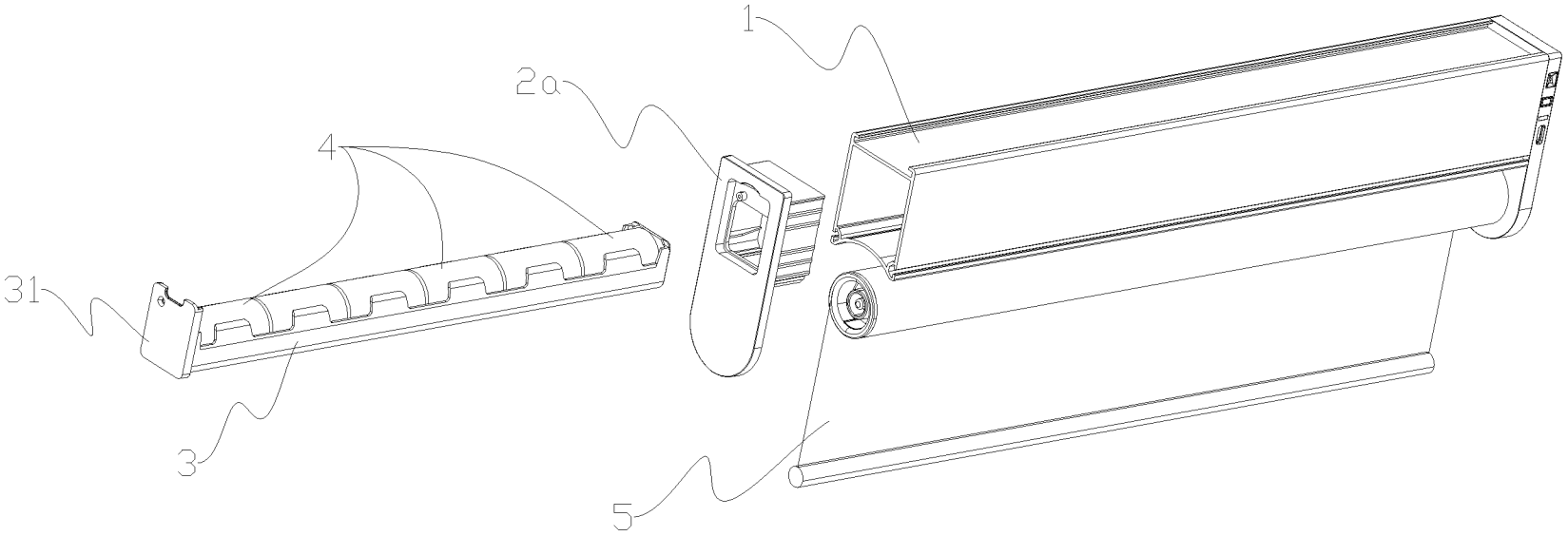
FIG. 2 is a schematic diagram of assembly structure of a smart roller curtain with a replaceable battery according to an embodiment of the present invention.
Figure 3:
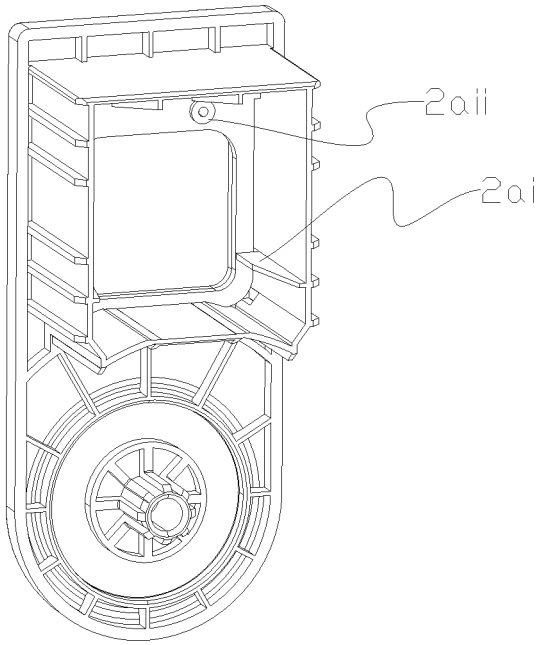
FIG. 3 is a perspective view of a mounting component in FIG. 2.
Figure 4:
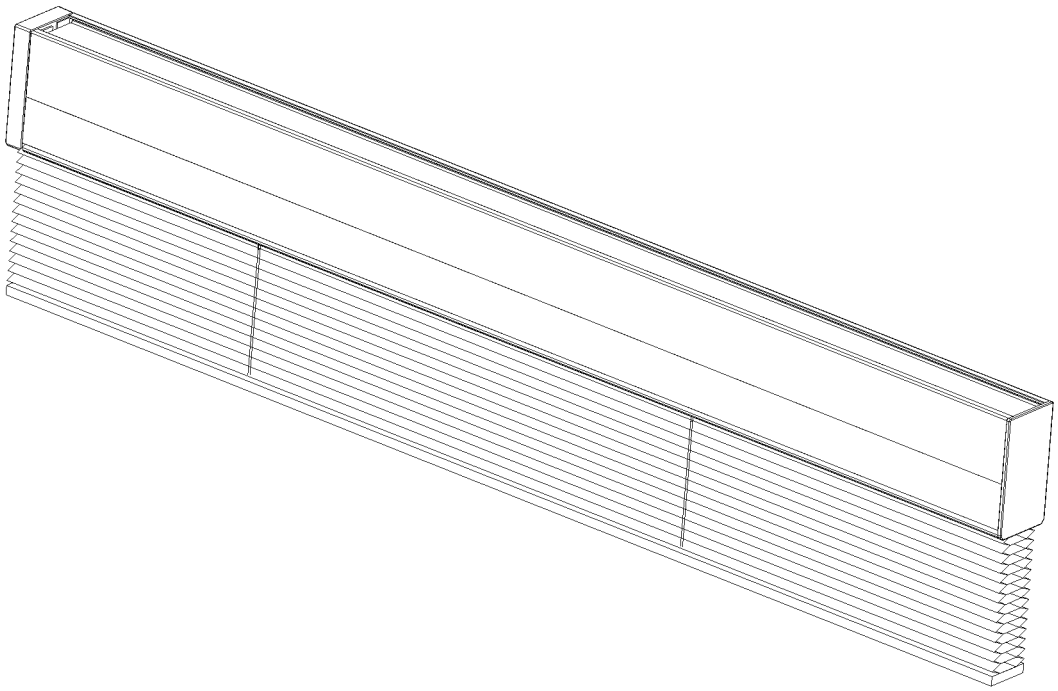
FIG. 4 is a perspective view of a smart blind curtain with a replaceable battery according to another embodiment of the present invention.
Figure 5:
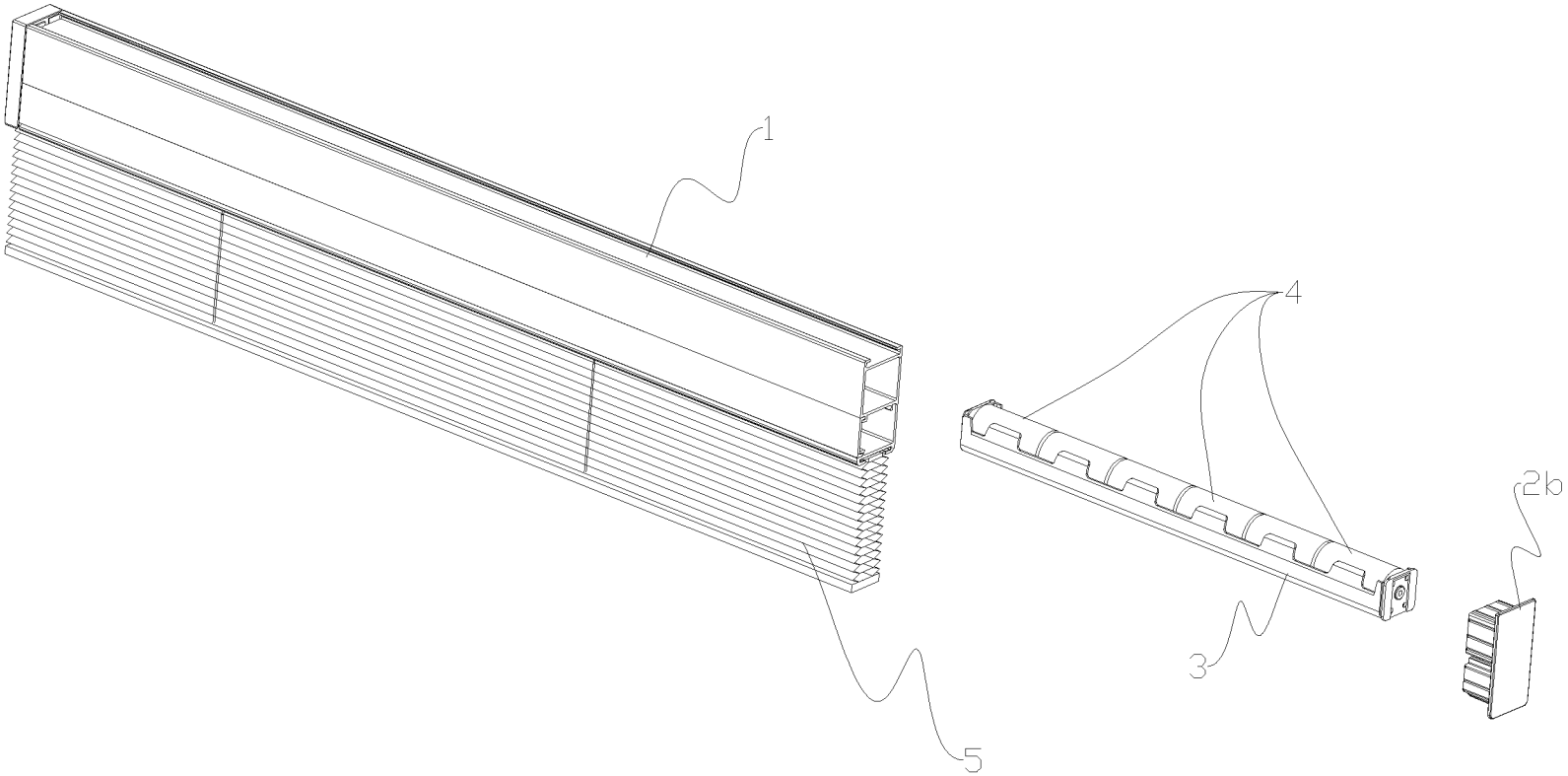
FIG. 5 is a schematic diagram of assembly structure of a smart blind curtain with a replaceable battery according to an embodiment of the present invention.
Figure 6:
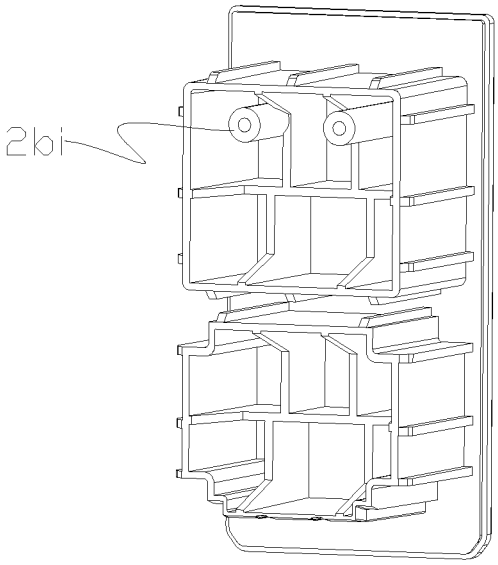
FIG. 6 is a perspective view of a mounting component in FIG. 5.

The present invention provides a smart sunshade curtain with a replaceable battery, which is described below with reference to the following two specific embodiments, i.e., a smart roller curtain and a smart blind curtain. FIG. 1 is a perspective view of a smart sunshade curtain with a replaceable battery, i.e., a roller curtain according to an embodiment of the present invention. FIG. 2 is a schematic diagram of assembly structure of a smart roller curtain with a replaceable battery according to an embodiment of the present invention. FIG. 3 is a perspective view of a mounting component in FIG. 2. FIG. 4 is a perspective view of a smart sunshade curtain with a replaceable battery, i.e., a blind curtain according to another embodiment of the present invention. FIG. 5 is a schematic diagram of assembly structure of a smart blind curtain with a replaceable battery according to an embodiment of the present invention. FIG. 6 is a perspective view of a mounting component in FIG. 5.

As shown in FIGS. 1 and 2 or FIGS. 4 and 5, the smart sunshade curtain with a replaceable battery according to the present invention comprises a cross beam 1 and mounting components covered on both ends of the cross beam 1. Components such as a power mechanism and a control panel are disposed in the cross beam 1, and a drive mechanism is disposed at the other end of the cross beam opposed to the power mechanism; the power mechanism transmits power to the drive mechanism to drive an output mechanism to move a curtain cloth 5. A power source of the power mechanism may be a primary battery, a secondary battery, and the like. The drive mechanism may comprise a tubular motor. According to different curtain forms, the drive mechanism may be disposed inside or outside the cross beam, and electrically connected with the power mechanism through the control panel, a circuit element, and the like.

To improve convenience of replacement or assembly or disassembly of the power mechanism, the power mechanism may be designed to be pulled out of or pushed into an end of the cross beam 1. In a specific application, the power mechanism has a drawer 3 that may be pulled out of or pushed into the cross beam 1, and battery assemblies 4 are arranged in the drawer 3 (the battery assemblies 4 may be connected in series or in parallel in the drawer 3 according to different specifications).

In the above structure, the batteries are arranged in sequence in the drawer 3 mounted inside the cross beam 1 to facilitate spatial arrangement design of internal elements of the cross beam 1 and prevent the batteries from being exposed to the outside, thereby improving aesthetics of the smart curtain. In addition, the power mechanism may be assembled and disassembled at any time. In this way, repair, replacement or charge of the power mechanism can be facilitated, and the batteries can be separated from the smart curtains during sales or transportation so as to reduce unnecessary power losses.

In a further improved embodiment, the power mechanism and the drive mechanism are electrically connected by an electric wire with a sufficient length which ensures that the drawer can be pulled out smoothly. In addition, preferably, the electric wire can be extended or retracted as the drawer is pulled or pushed, such that the electric wire is pulled or retracted conveniently when the power mechanism is pulled out of or pushed into the cross beam 1, thereby preventing the electric wire from being entangled inside the cross beam 1.

In a further improved embodiment, the power mechanism and the drive mechanism are electrically connected by a connection point of the electric wire that can be disconnected. For example, a connection point of a conductive connection sheet that can be disconnected may be disposed to facilitate pulling or pushing the power mechanism.

In a further improved embodiment, as shown in FIG. 3, the power mechanism is disposed at an end of the cross beam 1, an opening for the drawer 3 to pass through is disposed on the mounting component 2*a* at this end, and a pull plate 31 for covering the opening is correspondingly disposed on the drawer 3.

In a further improved embodiment, a guide strip 2*ai* is disposed at an inner wall of the mounting component 2*a* with the opening, such that the drawer 3 can be pulled out of or pushed into the cross beam 1.

In a further preferred embodiment, a first locking element is disposed on the mounting component 2*a* with the opening to mate with a second locking element disposed on the pull plate 31. In this way, the drawer 3 may be fixed inside the cross beam 1 after being pushed into the cross beam 1, thereby preventing the power mechanism from falling off during operation of the curtain. The locking elements may be screw hole 2*aii* structures fixed with screws as shown in FIGS. 2 and 3, or fitting structures mated with each other or the like.

In a further improved embodiment, as shown in FIG. 6, the power mechanism is disposed at an end of the cross beam 1, the mounting component 2*b* at this end closes the end after being covered on the end, and a limiting column 2*bi* to be abutted against the power mechanism is disposed at the inner wall of the mounting component 2*b* to prevent the power mechanism from moving during operation of the curtain.

Unless otherwise specified, materials, reagents and experimental equipment involved in the embodiments of the present invention are all commercially available products in the field of electrical elements.

The forgoing descriptions are merely made to the preferred embodiments of the present invention. It should be pointed out that modifications and improvements made to the present invention by those of ordinary skill in the art without departing from the core technology of the present invention shall fall within the scope of protection of the present invention. Any changes made within the meaning and scope equivalent to the claims of the present invention shall all fall within the scope of protection of the claims.

The invention claimed is:

1. A smart sunshade curtain, wherein the curtain comprises:

a cross beam with a first end and a second end arranged oppositely, and a drive mechanism is disposed at the second end of the cross beam;

mounting components, covering both the first and the second ends of the cross beam;

a power mechanism, disposed in the cross beam and has a drawer that may be pulled out of or pushed into one end of the cross beam, and battery assemblies are arranged in the drawer, wherein the drive mechanism is at one of the ends and the power mechanism is at the other of the ends, wherein the power mechanism is disposed at the first end of the cross beam; an opening for the drawer to pass through is disposed on the mounting component at the first end, and a pull plate for covering the opening is correspondingly disposed on the drawer.

2. The smart sunshade curtain of claim 1, wherein the power mechanism and the drive mechanism are electrically connected by an electric wire which extends or retracts as the drawer is pulled or pushed.

3. The smart sunshade curtain of claim 1, wherein the power mechanism and the drive mechanism are electrically connected by a connection point of the electric wire that can be disconnected.

4. The smart sunshade curtain of claim 1, wherein the power mechanism is disposed at the first end of the cross beam, the mounting component at the first end closes the first end after being covered on the first end, and a limiting column to be abutted against the power mechanism is disposed at an inner wall of the mounting component.

5. The smart sunshade curtain of claim 1, wherein a guide strip parallel to an axis of the cross beam is disposed at an inner wall of the mounting component with the opening.

6. The smart sunshade curtain of claim 5, wherein a first locking element is disposed on the mounting component with the opening, and a second locking element mated with the first locking element is disposed on the pull plate; the first and the second locking elements fix the drawer inside the cross beam after the drawer is pushed into the cross beam.

* * * * *